United States Patent [19]

Liska

[11] 4,195,569

[45] Apr. 1, 1980

[54] DEVICE FOR THE CIRCUMFERENTIAL ADJUSTMENT OF A FORM CYLINDER

[75] Inventor: Zbynek Liska, Adamov, Czechoslovakia

[73] Assignee: Adamovske strojirny, narodni podnik, Adamov, Czechoslovakia

[21] Appl. No.: 903,574

[22] Filed: May 8, 1978

[30] Foreign Application Priority Data

May 16, 1977 [CS] Czechoslovakia ..... 3173/77

[51] Int. Cl.[2] ..... B41F 13/14

[52] U.S. Cl. ..... 101/248; 101/181

[58] Field of Search ..... 101/248, 181, 286; 74/395, 397, 396, 401, 400, 402, 403

[56] References Cited

U.S. PATENT DOCUMENTS 2,181,895 12/1939 Huck ..... 101/248

3,308,752 3/1967 Stevenson ..... 101/248

FOREIGN PATENT DOCUMENTS 1200744 7/1970 United Kingdom ..... 101/248

1385941 3/1972 United Kingdom ..... 101/248

*Primary Examiner*—J. Reed Fisher

*Attorney, Agent, or Firm*—Burgess Ryan and Wayne

[57] ABSTRACT

An arrangement for adjusting the rotational phase angle of the form cylinder of a printing machine to obtain proper image registration, for example for multicolor printing operations. Adjustment is accomplished by a toothed ring which can be rotationally adjusted and which is slidably engaged with a connecting gear affixed to a drive gear. A control shaft may be rotated to axially move the drive gear with respect to the toothed ring, and an expandable radial bearing is coupled between the control shaft and the drive gear.

4 Claims, 3 Drawing Figures

DEVICE FOR THE CIRCUMFERENTIAL ADJUSTMENT OF A FORM CYLINDER

This invention relates to a device for the circumferential adjustment of a form cylinder during the operation of the printing machine to obtain a register printing, particularly on multicolour printing machines.

An object of the invention is a device for the accurate circumferential adjustment of a form cylinder during the printing operation of the machine to obtain a good register printing. One of the known devices for the circumferential adjustment of a form cylinder to obtain register printing consists of a pair of gears, where one of the gears provided with oblique teeth is rotatably arranged on a shaft, which is mounted in the side wall of the printing machine, and the other gear with straight teeth is shiftably and coaxially arranged on the printing cylinder. These gears engage a pair of pinions which are rigidly connected together and which are mounted on a countershaft. The end of the countershaft is provided with a thread, on which is screwed a body which is attached to the side wall of the printing machine. The countershaft has the function of a screw which is connected directly or by means of a transmission with a control knob.

A disadvantage of the above described device is in that four interconnected gears are required for the adjustment of the form cylinder, the inaccuracies and vibrations of which adversely influence the color inking and register of the print on the sheet.

Another known device of this kind is based on the same principle as the aforesaid device, but with the difference, that it has four gears with oblique teeth. The disadvantages of this device are the same as those of the aforesaid device.

Another known device is provided with a control mechanism which is arranged in a hollow shaft of the printing cylinder. This arrangement has the disadvantage, that the shaft of the printing cylinder is considerably reduced in strength and therefore exhibits an undesirable bowing of the shaft.

The above named disadvantages are avoided by a device according to the present invention, where on one side of a form cylinder is a bushing shiftably mounted on a pivot, on one end of which is fixed a drive gear with oblique teeth which is rigidly connected to a connecting gear and a backlash eliminating gear, the teeth of said gears being shiftably in engagement with an inner toothing of a toothed ring which is arranged in a sleeve fixed on the front side of the form cylinder, a gear being rotatably mounted in the middle part of the shiftable bushing, said gear being shiftably attached on a flange fixed to the second side wall of the printing machine. On the conical part of the shiftable bushing, there is mounted an expanding radial bearing, the inner ring of which is axially shiftable in the direction toward an outer ring of the bearing, which outer ring is fixed in a flange which is attached to the second side wall of the printing machine. One axial bearing bears on the shoulder of the shiftable bushing, whereby an inner distance ring and an outer distance ring are arranged between the second axial bearing and the expanding radial bearing. In the flange is screwed a nut which seats on the outer ring of the expanding radial bearing and on the end of the shiftable bushing a second nut is screwed, which nut seats on the inner ring of the expanding radial bearing.

The advantage of the device herein described is that it enables an easy and quick adjustment of the form cylinder, carrying a printing plate, in a position for register printing during the printing operation of the printing machine.

Another advantage of this device is that the radial play in the mounting of the axial shiftable drive gear is eliminated by means of the expanding radial bearing, whereby it is possible to adjust this play for a required value.

The invention will now be described in more detail with reference to an embodiment thereof illustrated in the accompanying drawings, in which.

Figure 1:
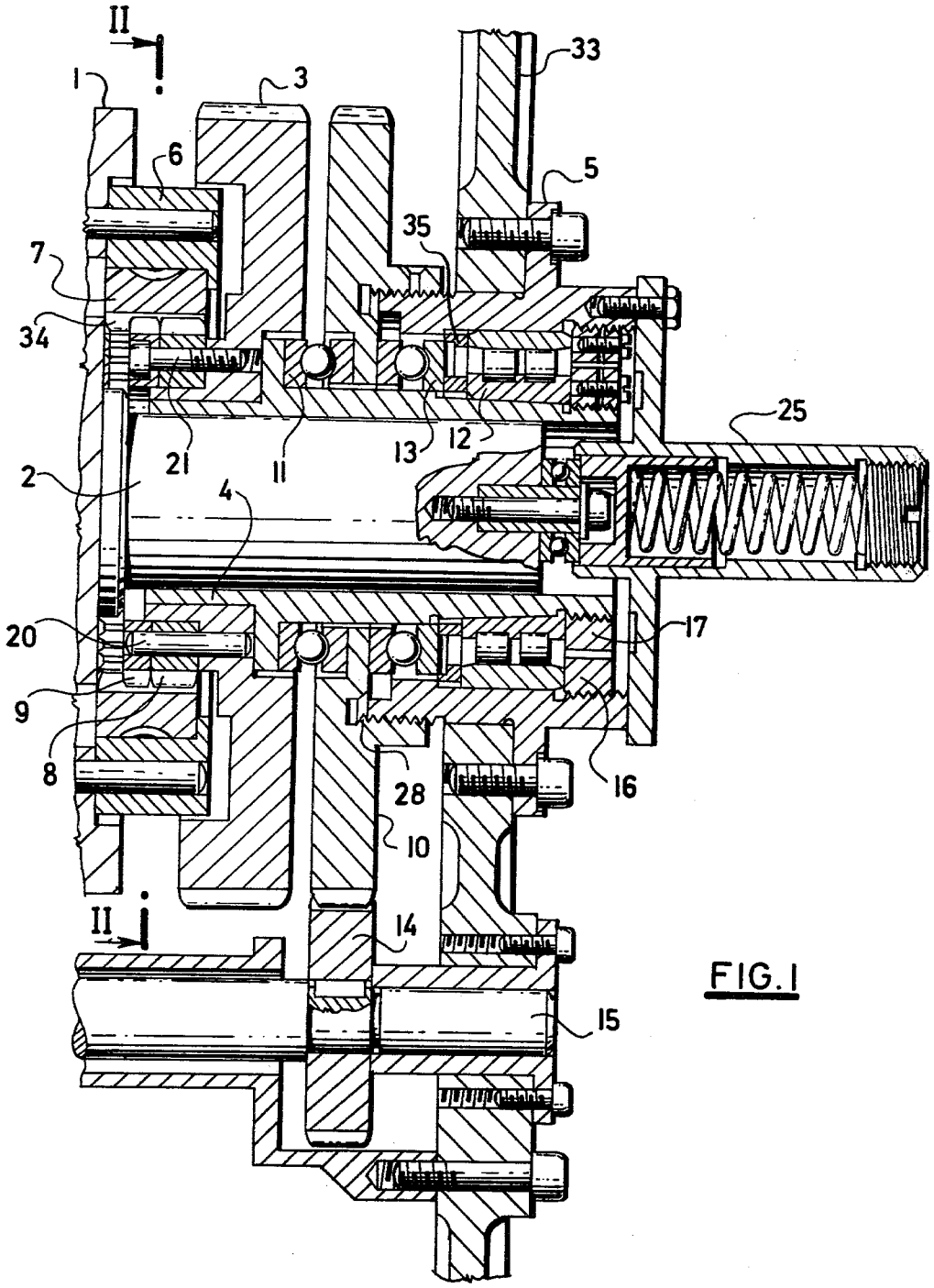
FIG. 1 shows a front elevation of the device in partial longitudinal section.
Figure 2:
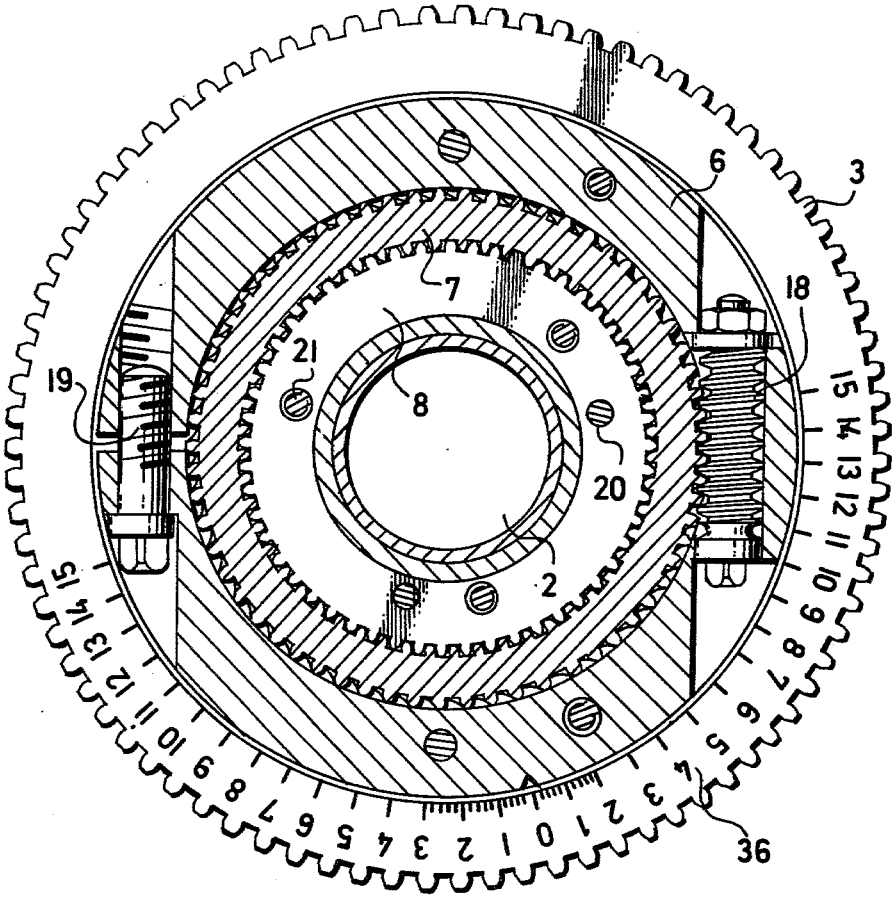
FIG. 2 is a sectional view of the device along a plane II—II of the device in FIG. 1.
Figure 3:
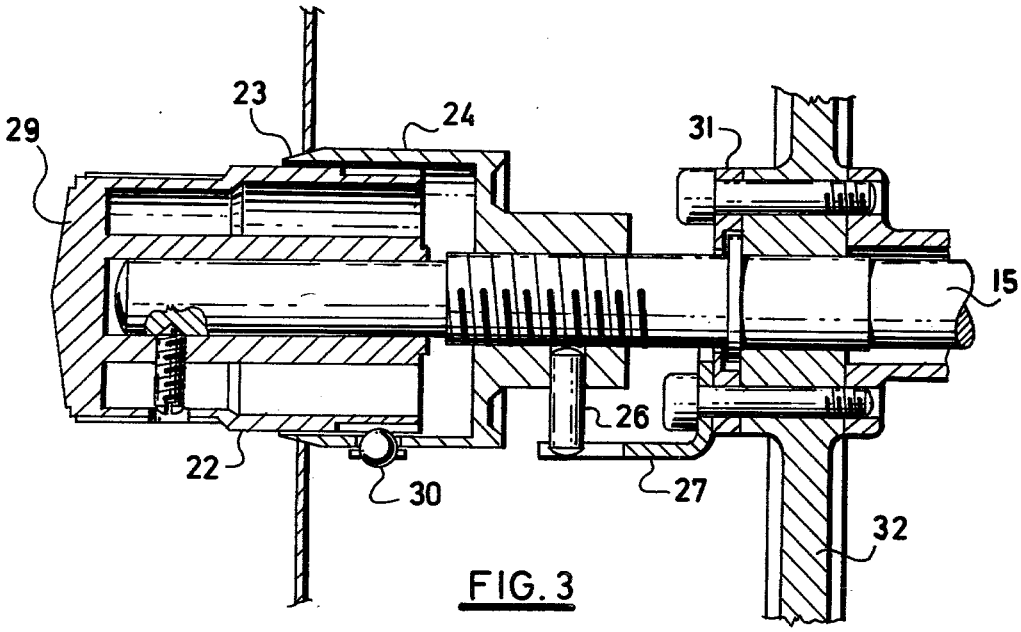
FIG. 3 shows a partial sectional view of a control knob connected to a control shaft.

The device according to the invention consists of a form cylinder 1 which is provided with cylinder shaft 2. On one side of the form cylinder 1, a shiftable bushing 4 is shiftably arranged on the cylinder shaft 2. A drive gear 3 with oblique teeth is rigidly mounted on one end of the shiftable bushing 4. The drive gear 3 engages with a gear with oblique teeth (not illustrated) of an offset cylinder. The cylinder shaft 2 and bushing 4 are urged axially against the bearing 11 by a spring within the end housing 25. The drive gear 3 is rigidly connected by means of screws 21 and pins 20 to a connecting gear 8 and a play eliminating gear 9. On the side wall of the drive gear 3, there is provided a scale 36 serving for the circumferential adjustment of the form cylinder 1, when the printing machine is not in operation. On the side wall of the form cylinder 1 is fixed a sleeve 6, in which is arranged a toothed ring 7 which is provided on its outer circumference with helical gears, which engages a worm 18 rotatably mounted in the sleeve 6.

The toothed ring 7 is provided with inner toothing 34, which is shiftably in engagement with the interconnecting gear 8 and the play eliminating gear 9. This engagement and connection enables the axial movement of the gear 3 and of the shiftable bushing 4 on the cylinder shaft 2. The sleeve 6 has a longitudinal flat on one part thereof. At the flat the sleeve 6 is provided with a securing screw 19. The toothed ring 7 is resilently secured in the sleeve 6 by means of a securing screw 19. By the securing of the toothed ring 7 in the sleeve 6, there is formed a rigid connection of the drive gear 3 with the form cylinder 1. In the middle part of the shiftable bushing 4 a gear 10 is rotatably mounted between two axial bearings 11. One of these axial bearings 11 seats on a shoulder formed on the shiftable bushing 4. The gear 10 is threadably engaged with the thread 28 on a flange 5 which is fixed to the second side wall 33 of the printing machine. On the conical part of the shiftable sleeve 4, there is mounted an expandible radial bearing 12, the inner ring of which is axially shiftable with respect to the outer ring which is fixed in the flange 5.

Between the second axial bearing 11 and the expanding radial bearing 12 on the shiftable bushing 4 is mounted an inner expanding ring 13 and an outer expanding ring 35. The expanding radial bearing 12 is pressed by means of the nuts 16 and 17 on the conical surface of the shiftable bushing 4. The nut 16 seats on the outer ring of the expanding radial bearing 12 and is secured in the flange 5. The second nut 17 seats on the inner ring of the expanding radial bearing 12 and is screwed on the end of the shiftable bushing 4. The gear 10 is in engagement with the pinion 14 which is fixed on one end of a control shaft 15. The control shaft 15 is rotationally mounted in side walls 32 and 33 of the printing machine. On the other end of the control shaft 15 a control knob 29 is attached which is provided with a scale 22. The control shaft 15 is provided with a thread, on which is screwed a threaded screw 24, on which is mounted a securing pin 26. The securing pin 26 is located with one end in the cutout of the holder 7. The threaded sleeve 24 is provided with a detent ball 30 which cooperates with positional (position giving) grooves which are formed on the control knob 29. The threaded sleeve 24 is provided with a mark 23, by means of which it is possible to set on the scale 22 of the knob 29 the required value of the circumferential turning and adjustment of the form cylinder 1. The holder 27 together with a strap plate 31 is fixed on the first side wall 32 of the printing machine. On the front side of the flange 5 a cushioned (sprung) holder 25 is attached the body of which bears on the radial bearing which is mounted on the end of the pivot 2.

The device according to the invention operates as follows:

The circumferential turning of the form cylinder 1 for an adjustment for register printing, is carried out by turning the control shaft 15 by means of the knob 29. Simultaneously with the turning of the control shaft 15 the pinion 14 is also turned, as a result of which the gear 10 is turned. As a result of the turning of the gear 10, which is mounted on a thread provided on the flange 5, the gear 10 is axially displaced. Simultaneously with the axial displacement of the gear 10, the shiftable bushing 4 with the drive gear 3 is axially shifted on the cylinder shaft 2. The axial shifting of the drive gear 3 is enabled by the shifting of the connecting gear 8 and of the play eliminating gear 9 in the inner toothing 34 of the toothed ring 7. With the shifting of the shiftable bushing 4 on the pivot 2, the inner ring of the expanding radial bearing 12 is also shifted toward the outer ring of the radial bearing 12. Due to the axial shifting of the drive gear 3 a circumferential turning of the form cylinder 1 is achieved, in such a way that the drive gear 3 with oblique teeth is in engagement with the gear with oblique teeth which is attached to the offset cylinder not illustrated.

To avoid an undesired displacement of the adjusted position of the form cylinder 1, the knob 29 is secured in the threaded sleeve 24 by means of a detent ball 30. The threaded sleeve 24 is secured against turning by means of a pin 26, one end of which is received in the cut out of the holder 27. By turning of the control shaft 15 which is provided with a thread, the threaded sleeve 24 is axially shifted, said sleeve being provided with a mark 23 indicating on the scale 22 of the control knob 29 the value of the circumferential angle and adjustment of the form cylinder 1 for register printing. This circumferential adjustment of the form cylinder to obtain the register printing is carried out during the printing operation of the printing machine.

When the printing machine is not in operation, the circumferential angle and adjustment of the form cylinder 1 is carried out by turning the sleeve 6 by means of the worm 18 which engages the teeth of the toothed ring 7. By releasing the securing screw 19 the sleeve 6 is loosened from the toothed ring 7. By turning the worm 18 the sleeve 6 is turned together with the form cylinder 1, whereas the toothed ring 7 is not turned, because it is interlocked by the drive gear 3 which is in engagement with a gear of the offset cylinder with oblique teeth not illustrated. When the circumferential adjustment of the form cylinder 1 is carried out, the toothed ring 7 is firmly secured in the sleeve by means of the securing screw 19. The angle of rotation of the form cylinder 1 is set when the printing machine is not in operation, on the scale 36 which is provided on the drive gear 3.

What we claim is:

1. A device for circumferential adjustment of a form cylinder of a printing machine, for the purpose of obtaining proper registration of an image to be printed, comprising:

a form cylinder;

a cylinder shaft mounted on one side of said cylinder and rotatably coupled thereto;

an axially shiftable bushing mounted on said cylinder shaft;

a drive gear with oblique teeth affixed to one end of said shiftable bushing;

an externally toothed interconnecting gear coaxial with and rigidly connected to said drive gear;

an externally toothed backlash eliminating gear rigidly connected to said interconnecting gear, said gears being mutually coaxial;

a toothed ring coaxial with and having an inner toothed surface in axially shiftable engagement with the teeth of said interconnecting and backlash eliminating gears;

a sleeve affixed to a front side of said form cylinder, said toothed ring being disposed within said sleeve;

a fourth gear rotationally mounted coaxial with said drive, interconnecting and backlash eliminating gears;

two axial bearings mounted on said shiftable bushing for supporting said fourth gear, one of said bearings axially abutting a shoulder of said bushing to urge said bushing in the axial direction toward said form cylinder;

a flange affixed to a side wall of the printing machine, said fourth gear being threadably engaged with said flange for axial movement with respect thereto.

2. The device according to claim 1, wherein said shiftable bushing has a conical outer surface part and further comprising an expandable radial bearing having an outer ring and an axially shiftable inner ring, said bearing being mounted on the conical part of said shiftable bushing, the outer ring of said expandable radial bearing being affixed to said side wall of said printing machine.

3. The device according to claim 2, wherein said shiftable bushing has a shoulder, one of said axial bearings being seated on said shoulder between the other axial bearing and said expandable radial bearing.

4. The device according to claim 2, further comprising a nut mounted on said flange and bearing against the outer ring of said expandable radial bearing, and another nut on the end of said shiftable bushing and bearing on the inner ring of said expandable radial bearing.

* * * * *

UNITED STATES PATENT OFFICE
CERTIFICATE OF CORRECTION

Patent No. 4,195,569 Dated April 1, 1980

Inventor(s) Zbynek Liska

It is certified that error appears in the above-identified patent and that said Letters Patent are hereby corrected as shown below:

Column 2, line 38: "engages" should be --engage--.

Column 3, line 11: "holder 7" should be --holder 27--.

lines 23 and 40: "pivot 2" should be --cylinder shaft 2--.

line 47: "not illustrated" should be --(not illustrated --.

Column 4, lines 6-7: "not illustrated" should be --(not illustrated)--.

Signed and Sealed this

Fourteenth Day of October 1980

[SEAL]

Attest:

SIDNEY A. DIAMOND

Attesting Officer

Commissioner of Patents and Trademark